United States Patent [19]

Cann et al.

[11] 4,286,435

[45] Sep. 1, 1981

[54] HOT GAS DEFROST SYSTEM

[75] Inventors: Peter L. Cann, Canastota; Paul S. Sacks, Cazenovia, both of N.Y.

[73] Assignee: Carrier Corporation, Syracuse, N.Y.

[21] Appl. No.: 103,834

[22] Filed: Dec. 12, 1979

Related U.S. Application Data

[62] Division of Ser. No. 947,980, Oct. 2, 1978, Pat. No. 4,215,555.

[51] Int. Cl.[3] ..... F25B 41/00

[52] U.S. Cl. ..... 62/81; 62/196 R; 62/278

[58] Field of Search ..... 62/81, 83, 160, 174, 62/196 B, 324 E, 503, 196 R, 278

[56] References Cited

U.S. PATENT DOCUMENTS

| | | | |
|---|---|---|---|
| 2,440,146 | 4/1948 | Kramer | 62/278 X |
| 3,138,007 | 6/1964 | Friedman et al. | 62/278 |
| 3,167,930 | 2/1965 | Block et al. | 62/81 X |
| 3,429,139 | 2/1969 | Wile et al. | 62/278 |
| 3,636,723 | 1/1972 | Kramer | 62/278 X |
| 3,677,025 | 7/1972 | Payne | 62/81 |
| 3,734,810 | 5/1973 | Davis | 62/196 B |
| 4,122,688 | 10/1978 | Mochizuki et al. | 62/196 R |

*Primary Examiner*—Lloyd L. King

*Attorney, Agent, or Firm*—J. Raymond Curtin; Robert P. Hayter

[57] ABSTRACT

A method and apparatus utilizing a hot gas defrost system wherein superheated gas from the system compressor outlet is conducted directly into the heat exchanger to be defrosted, by-passing the condenser and thermal expansion valve to effect removal of the frost and ice accumulation on the heat exchanger surface. A portion of the hot compressor discharge gas is conducted directly into an accumulator with the liquid refrigerant received from the heat exchanger to be defrosted, the liquid refrigerant resulting from the gaseous refrigerant being condensed in the heat exchanger as the ice is melted. The refrigerant condensed to a liquid during defrost is vaporized in the accumulator thereby providing a supply of gaseous refrigerant to the compressor suction line, said gaseous refrigerant being a combination of the non-condensed discharge gas conducted to the accumulator and the liquid refrigerant vaporized in the accumulator.

4 Claims, 1 Drawing Figure

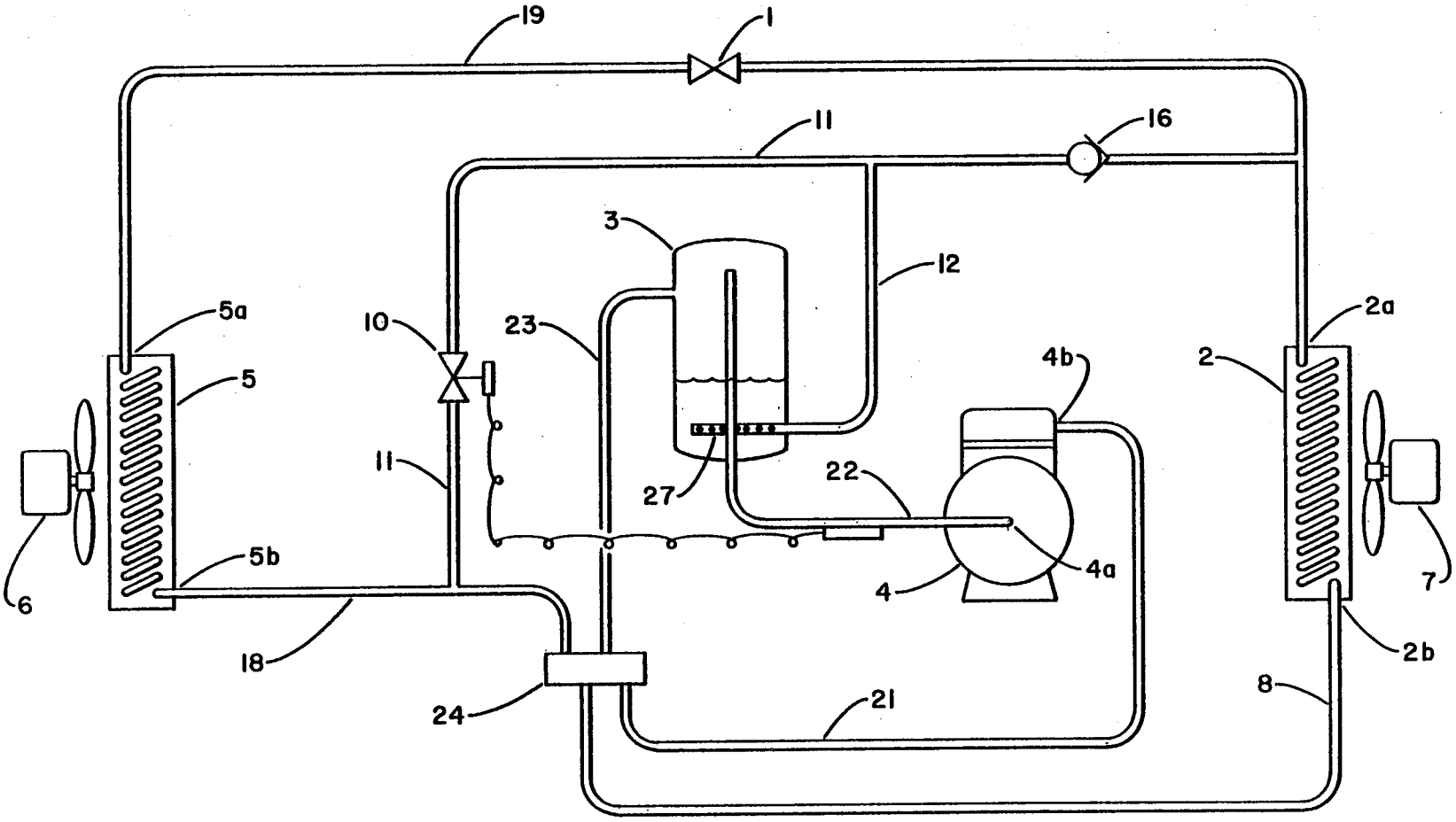
1
2
2a
2b
3
4
4a
4b
5
5a
5b
6
7
8
10
11
11
12
16
18
19
21
22
23
24
27

HOT GAS DEFROST SYSTEM

This is a division of application Ser. No. 947,980 filed Oct. 2, 1978, now U.S. Pat. No. 4,215,555.

BACKGROUND OF THE INVENTION

This invention relates in general to refrigeration circuits, and, in particular, to a defrost system for a refrigeration circuit such as may be incorporated in air conditioning apparatus including a heat pump.

More specifically, but without restriction to the particular use which is shown and described, this invention relates to a hot gas defrost system wherein a portion of the superheated gaseous heat transfer fluid is conducted through a heat exchanger to melt accumulated ice from the heat exchanger thereby causing the heat transfer fluid passing within the heat exchanger to condense. The condensed heat transfer fluid is passed through a suction line to an accumulator into which a portion of the superheated gaseous heat transfer fluid is conducted. The gaseous superheated refrigerant acts to vaporize the condensed heat transfer fluid contained within the accumulator to provide a supply of gaseous refrigerant to the compressor inlet.

Heat pumps, for example, function to transfer heat between an indoor coil and an outdoor coil through the use of a heat-exchange fluid which is selectively vaporized and condensed in accordance with the desired mode of operation. During warm weather, warm air indoors is circulated about an indoor coil so that the heat from the indoor air is absorbed by the heat-exchange fluid, or refrigerant, which is then carried outdoors to the outdoor coil releasing the heat to the surrounding air. In cold weather the cycle is reversed. Heat, which has already been produced outdoors by the sun and stored in the earth and air, is transferred to the heat-exchange fluid by the outdoor coil and discharged from the heat-exchange fluid indoors.

One of the frequently encountered and well known problems associated with such heat pump equipment is that during heating operations the outdoor coil, which is functioning as an evaporator, tends to accumulate frost or ice when the appropriate weather conditions occur. The accumulation of frost on the outdoor coil reduces the ability of the heat exchanger to transfer heat from the ambient air in contact with the heat exchanger surfaces to the refrigerant. In order to remove the accumulated frost and ice from the surfaces of the outdoor coil, various automatic defrosting systems have been devised. These systems include heating the coil from an external heat source, and reversing the operation of the system to pass hot refrigerant gas through the outdoor coil.

In such hot gas reverse defrost systems, the gas conducted to the outdoor coil melts the ice formed thereon and thereby changes state from a gas to a liquid within the outdoor coil. The condensed heat-exchange fluid, or liquid refrigerant, is then flashed to a gas in an evaporator and any remaining liquid refrigerant is collected in an accumulator which separates and retains liquid refrigerant to prevent the liquid from being conveyed into and damaging the system compressor. Liquid refrigerant in the compressor is called "slugging" and may result in physical damage to the compressor components.

While such systems are satisfactory for removing the accumulation of ice from the outdoor coil, and preventing the liquid refrigerant from damaging the system compressor, the reversing process however causes high system stress and high system noise level during abrupt system reversals. Such systems usually require a second heat source, usually electric resistance heat to replace the heat removed from the indoor space by the indoor coil during defrost. In addition, as liquid refrigerant is accumulated in the accumulator, provision must be made to remove the accumulation, such as by re-introducing a controlled amount of the liquid into the gaseous refrigerant as a fine suspension through an accumulator.

In the present hot gas defrost system, superheated defrosting gas is by-passed around the expansion valve and discharged from the compressor outlet directly into the inlet of the outdoor coil wherein the hot gas is condensed melting the ice and liquid refrigerant or a mixture of gaseous and liquid refrigerant is discharged from the outdoor coil outlet. The outlet from the outdoor coil is coupled to a component which serves as an accumulator to prevent the liquid refrigerant from being introduced into the system compressor and as a re-evaporator to vaporize the liquid refrigerant received from the compressor. A portion of the superheated hot gas by-passes the indoor coil and expansion valve and is introduced directly into the liquid refrigerant contained in the accumulator to vaporize the liquid refrigerant. The vaporized liquid refrigerant is thereby returned for use by the system compressor providing a more efficient system to control defrost operation. The heat energy of this defrost system may be constantly monitored to determine when defrost has been effected. The accumulator serves as a receiver for storing liquid refrigerant during heat transfer operation and as a direct contact heat exchanger during defrost operations.

SUMMARY OF THE INVENTION

It is an object of this invention to provide an improved system for removing the accumulation of frost or ice on a heat exchanger coil.

Another object of this invention is to return the gaseous refrigerant condensed to a liquid during the defrost mode of operation to the system compressor in a vaporized form.

A further object of this invention is to increase heat transfer efficiency through removal of frost and ice from a heat exchanger coil and to return the condensed refrigerant for use in the system.

Still another object of this invention is to remove accumulated frost or ice from the outdoor coil of a heat pump without withdrawing heat from the area to be conditioned to effect defrosting.

Another object of the invention is to improve system reliability by providing a non-reverse defrost system to reduce component stress for melting ice formed on the evaporator of a refrigeration system.

Yet another object of this invention is to improve both defrost efficiency and control of the defrost operation.

A yet further object of the present invention is to have a combination accumulator and re-evaporator within a refrigeration system.

These and other objects are attained in accordance with the present invention as it applies to a heat pump utilizing an indoor coil and an outdoor coil wherein there is provided a hot gas defrost system utilizing superheated gas from the system compressor outlet which is conducted directly into the heat exchanger to be defrosted. The indoor coil and thermal expansion valve are by-passed and the hot compressed gas is routed into the outdoor heat exchanger coil to effect removal of the frost and ice accumulation on the coil surface. A major portion of the hot gas is discharged directly into an accumulator containing liquid refrigerant condensed as heat is transferred from the gaseous refrigerant to the heat exchanger to defrost the heat exchanger surfaces. The hot gas acts to vaporize the liquid refrigerant within the accumulator for the return of gaseous refrigerant to the system compressor.

DESCRIPTION OF THE DRAWING

Further objects of the invention, together with additional features containing thereto and advantages accruing therefrom, will be apparent from the following description of a preferred embodiment of the invention which is shown in the accompanying drawing which is a schematic representation of a heat pump system constructed and adapted to be operated in accordance with the present invention.

DESCRIPTION OF A PREFERRED EMBODIMENT

Referring now to the drawing, there is shown a heat pump system in which an expansion valve 1, an outdoor coil 2, an accumulator 3, a compressor 4, an indoor coil 5, and a reversing valve 24 are connected in a closed fluidic circuit for effecting the transfer of heat between the outdoor coil and the indoor coil. The compressor 4 has an outlet 4*b* in fluid communication with an inlet 5*a* of the indoor coil 5 thru reversing valve 24 for discharging superheated gaseous refrigerant thereinto for effecting heating of an enclosure during operation of the refrigeration system.

In the heating mode of operation as the heat exchange fluid is passed from compressor 4 through conduit 21 to reversing valve 24, thru line 18 and through the indoor coil 5, a fan 6 is energized to direct a stream of air through the coil effecting heat transfer between the heat exchange fluid and the enclosure whereby the gaseous refrigerant is condensed to a liquid. An outlet 5*a* of the indoor coil 5 is coupled by conduit 19 to the expansion valve 1 through which the refrigerant passes and enters inlet 2*a* of the outdoor coil 2. A second fan 7 is energized to effect heat transfer between outdoor air and the heat exchange fluid passing through the coil 2 such that the liquid refrigerant is vaporized to a gaseous refrigerant. After heat transfer has been effected through the outdoor coil 2, the heat exchange fluid passes from an outdoor coil outlet 2*b* through a discharge conduit 8, reversing valve 24, and conduit 23 into the accumulator 3. The gaseous refrigerant is then passed from the accumulator thru conduit 22 to inlet 4*a* of the compressor 4 to repeat the cycle as is known to those skilled in the art. In the cooling mode of operation the reversing valve acts to reverse the flow of refrigerant such that the outdoor coil becomes the condenser and the indoor coil becomes the evaporator.

After the heat pump system has been in operation in the heating mode, frost or ice may form on the outdoor coil 2. The amount of frost and rate of accumulation are dependent upon the ambient environmental conditions. When ice accumulates on the outdoor coil 2, the heat transfer efficiency of the refrigeration system decreases and, therefore, the accumulation of ice must be removed to maintain efficiency within the system. Upon the accumulation of a sufficient amount of ice on the outdoor coil 2, the ice is melted from the coil by circulating hot refrigerant through the coil. While detection of this predetermined amount of ice accumulation to determine an initiation point for the defrost cycle does not form a part of the present invention, such defrost cycle may be initiated periodically by means of a timer, or other suitable system for the detection of an amount of ice on the coil.

When the defrost cycle has been initiated and the unit is in the heating mode of operation, a by-pass valve 10 in conduit 11 is opened providing fluid communication between the discharge outlet 4*b* of compressor 4 and the parallel coupled inlet 2*a* of the outdoor coil 2 and by-pass conduit 12 which is connected to accumulator 3. Upon opening of the by-pass valve 10, superheated discharge gas from the outlet 4*b* of the compressor 4 passes through reversing valve 24, conduit 18 and conduit 11 into the by-pass conduit 12 and the inlet 2*a* of the outdoor coil 2. A portion of the superheated discharge gas passes into outdoor coil 2 wherein the refrigerant absorbs heat from the coil to melt the ice thereon. A portion of the superheated discharge gas passes directly into accumulator 3 through by-pass conduit 12. The gas conducted thru the outdoor coil 2 loses its superheat plus latent energy to the ice thereby melting the accumulation of ice formed on outdoor coil 2 and a portion of said gas being condensed to a liquid.

During defrost some of the refrigerant is condensed in outdoor coil 2. The liquid refrigerant from the outdoor coil then passes through conduit 8 and the reversing valve to accumulator 3. The other portion of the superheated discharge gas passing through by-pass conduit 12, is discharged into the liquid refrigerant contained in accumulator 3 thru bubbler pipe 27 thereby vaporizing a portion of the liquid refrigerant contained therein. The direct discharge of superheated discharge gas into the accumulator 3 supplies a sufficient amount of gaseous refrigerant to inlet 4*a* of compressor 4, in combination with vaporizing the accumulated liquid refrigerant contained in the accumulator through the loss of the superheat energy of the discharge gas, to maintain the saturated suction temperature of the refrigeration system above the melting temperature of the ice.

After the ice has been melted from the outdoor coil 2, the superheated discharge gas passing therethrough will no longer have heat absorbed therefrom by ice on the coil. Therefore, the heat energy of the system will increase at a rate related to the input from the system compressor 4. This increase in the system energy can then be utilized to terminate the defrost cycle as upon the reaching of a predetermined suction temperature (e.g.: 45° F.).

Check valve 16 in conduit 11 serves to maintain refrigerant flow in the proper direction through the conduits during system operation and defrost operation. Valve 10 for by-passing the indoor coil to commence defrost is shown connected to a temperature sensing bulb to indicate that the valve may be set to close when a predetermined temperature level is detected in the hot gas passing thru conduit 22. Valve 10 opens upon defrost initiation commenced by a defrost control as is well known in the art.

Accumulator 3 is shown as a unitary shell component serving both to receive liquid refrigerant and to re-evaporate said refrigerant. The conduit 23 discharges refrigerant at least a portion of which is liquid during defrost into the accumulator. The liquid refrigerant collects within the bottom portion of the accumulator container and gaseous refrigerant within the top portion of the accumulator container. Compressor suction line 22 is connected to withdraw the gaseous refrigerant from within the top portion of the container. During defrost bypass conduit 12 conducts superheated gaseous refrigerant from the compressor discharge into the accumulator to vaporize a portion of the collected liquid refrigerant. This gaseous refrigerant may be discharged into a bubbler tube (27) which is immersed within the collected liquid refrigerant in the accumulator. Consequently superheated refrigerant is bubbled through the accumulated liquid refrigerant such that the superheat of the vapor is transferred to the liquid refrigerant vaporizing a portion thereof.

The invention has been described herein in reference to a heat pump system designed to transfer heat between an outdoor coil and an indoor coil. It is to be understood that this invention has like applicability to other forms of refrigeration systems including air conditioning equipment for supplying only cooling to an enclosure as well as air conditioning equipment for supplying both heating and cooling to an enclosure or heating only.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out the invention, but that the invention will include all embodiments falling within the scope of the appended claims.

What is claimed is:

1. A method of defrosting a heat exchanger coil in a refrigeration system comprising the steps of:

discharging a portion of the gaseous heat exchange fluid from a compressor outlet into the inlet of a heat exchanger coil having ice accumulated thereon;

circulating the heat exchange fluid through the coil wherein at least a portion of said heat exchange fluid is condensed such that heat is extracted therefrom to melt the ice accumulated on the coil;

passing the condensed heat exchange fluid from the heat exchanger coil outlet into an accumulator which serves as a reservoir for refrigerant during heat transfer operations and a heat interchanger during defrost operations;

by-passing a portion of the gaseous heat exchange fluid discharged from the compressor outlet and introducing said portion in heat exchange relationship with the liquid heat exchange fluid in the accumulator from the step of passing to thereby vaporize at least a portion of the liquid contained therein; and conducting gaseous heat exchange fluid from the accumulator into the compressor inlet.

2. The method as set forth in claim 1 wherein the step of by-passing includes supplying sufficient heat energy to the liquid heat exchange fluid in the accumulator to maintain sufficient compressor suction temperature such that the temperature of the compressor discharge is sufficiently high to melt the ice accumulated on the coil and the accumulator is a direct contact heat exchanger.

3. A method of defrosting a heat exchanger coil in a refrigeration system as described in claim 1 further including the step of terminating said discharging of gaseous heat exchange fluid from the compressor into the inlet of the heat exchanger coil in response to a predetermined increase in the heat energy of the refrigeration system.

4. A method of defrosting a heat exchanger coil in a refrigeration system as described in claim 3 wherein the predetermined increase in the heat energy of the refrigeration system comprises the suction temperature of the refrigerant being greater than the melting temperature of the ice accumulated on the heat exchanger coil.

* * * * *